US005657660A

United States Patent [19]

Tingvall

[11] Patent Number: 5,657,660

[45] Date of Patent: Aug. 19, 1997

[54] ARRANGEMENT FOR FASTENING A ROLL-UNIT FIRMLY TO A ROLL STAND

[75] Inventor: Lars Tingvall, Smedjebacken, Sweden

[73] Assignee: Morgardshammar AB, Smedjebacken, Sweden

[21] Appl. No.: 522,324

[22] PCT Filed: Mar. 14, 1994

[86] PCT No.: PCT/SE94/00212

§ 371 Date: Sep. 12, 1995

§ 102(e) Date: Sep. 12, 1995

[87] PCT Pub. No.: WO94/21396

PCT Pub. Date: Sep. 29, 1994

[30] Foreign Application Priority Data

Mar. 15, 1993 [SE] Sweden ..... 9300847

[51] Int. Cl.[6] ..... B21B 31/02

[52] U.S. Cl. ..... 72/237

[58] Field of Search ..... 72/237, 238, 239; 100/155 R, 168, 176

[56] References Cited

U.S. PATENT DOCUMENTS 4,314,469 2/1982 Kitamura et al. ..... 72/237

5,050,415 9/1991 Albers et al. ..... 72/237

FOREIGN PATENT DOCUMENTS 0 042 879 1/1982 European Pat. Off. .

1.349.021 12/1963 France .

*Primary Examiner*—Lowell A. Larson

*Assistant Examiner*—Thomas C. Schoeffler

*Attorney, Agent, or Firm*—Young & Thompson

[57] ABSTRACT

Arrangement for fastening a roll unit carrier (2) firmly to roll stand. The roll stand comprises a fastening device (15) which is journalled eccentrically in a rotatable cylindrical member (14) and has one end (16) provided with a fastening surface (16*a*) which in the fastening mode of the arrangement coacts with a complementary surface on the carrier (2). The arrangement includes elements (17, 18) for rotating the cylindrical member between a fastening position in which the carrier is pressed against the roll stand at a predetermined force, and a release position in which the carrier can be moved towards or away from the roll stand without being impeded by the fastening device.

6 Claims, 4 Drawing Sheets

ARRANGEMENT FOR FASTENING A ROLL-UNIT FIRMLY TO A ROLL STAND

FIELD OF THE INVENTION

The present invention relates to an arrangement for fastening a roll-unit carrier firmly to a roll stand, wherein the carrier can be displaced linearly into alignment with the roll stand.

BACKGROUND OF THE INVENTION

Modern roll stands are often constructed for quick exchange of the roll unit. In the case of one known construction of this kind, the roll unit is carried by a carrier or cassette which can be moved linearly in relation to the remainder of the roll stand with the aid of a mechanism mounted on the base structure that supports the stand, so as to enable the roll unit to be removed and replaced with a new roll unit. In order to enable this exchange to be made quickly, it must be possible to quickly release the carrier from and to quickly fasten the carrier to the remainder of the roll stand. High demands are placed on such fastening arrangements because of the large forces that are generated when rolling materials in a rolling mill, particularly in view of the fact that the force with which the carrier is fastened to the remainder of the roll stand must be so great that the carrier and that part of the unit to which it is coupled will function as a homogenous unit in the operation of the rolling mill. Fastening forces in the region of about 1000 kN are required in meeting this demand.

SUMMARY OF THE INVENTION

An object of the present invention is to provide a fastener arrangement of the aforesaid kind which will produce the requisite fastening force and which is also very reliable in operation.

This object is achieved in accordance with the invention with an arrangement of the kind defined in the introduction which is characterized in that the roll stand includes a fastener device which is journalled eccentrically in a rotatable cylindrical member and which has an end which includes a fastening surface which in the fastening position of said fastener device coacts with a complementary surface on the carrier, and in that means are provided for rotating the cylindrical member between a fastening position in which the carrier is pressed against the roll stand with a predetermined force, and a release position in which the carrier can be moved towards or away from the roll stand without being impeded by the fastener device. The use of an eccentrically journalled fastener device enables very powerful fastening forces to be obtained with a relatively limited power input for generating and maintaining the fastening or securing force.

According to one preferred embodiment of the fastener arrangement, the fastener device is journalled for axial movement in the cylindrical member, between an inserted position in which the carrier is able to move linearly into abutment with the roll stand, and an extended position in which movement of the carrier is prevented. The arrangement also includes means for preventing rotation of the fastener device, and the cylindrical member includes a pin which runs in a channel in the fastener device and controls axial movement of said fastener device in relation to the cylindrical member.

BRIEF DESCRIPTION OF THE DRAWINGS

A preferred embodiment of an inventive fastener arrangement will now be described in more detail with reference to the accompanying drawings, in which.

DETAILED DESCRIPTION OF THE INVENTION

Figure 1:
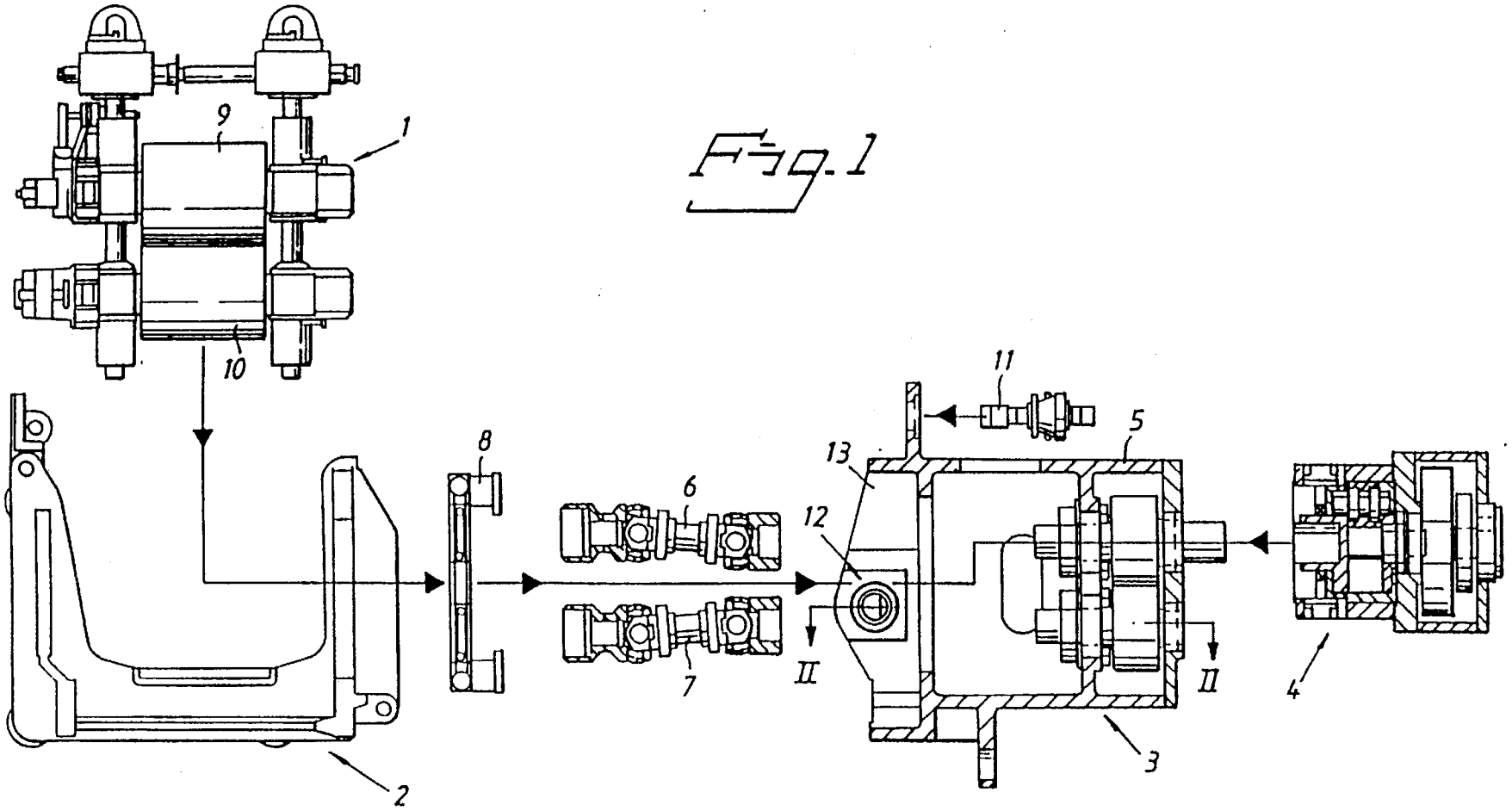
FIG. 1 is a side view of a roll stand and shows the various stand components in an unassembled state.
Figure 2:
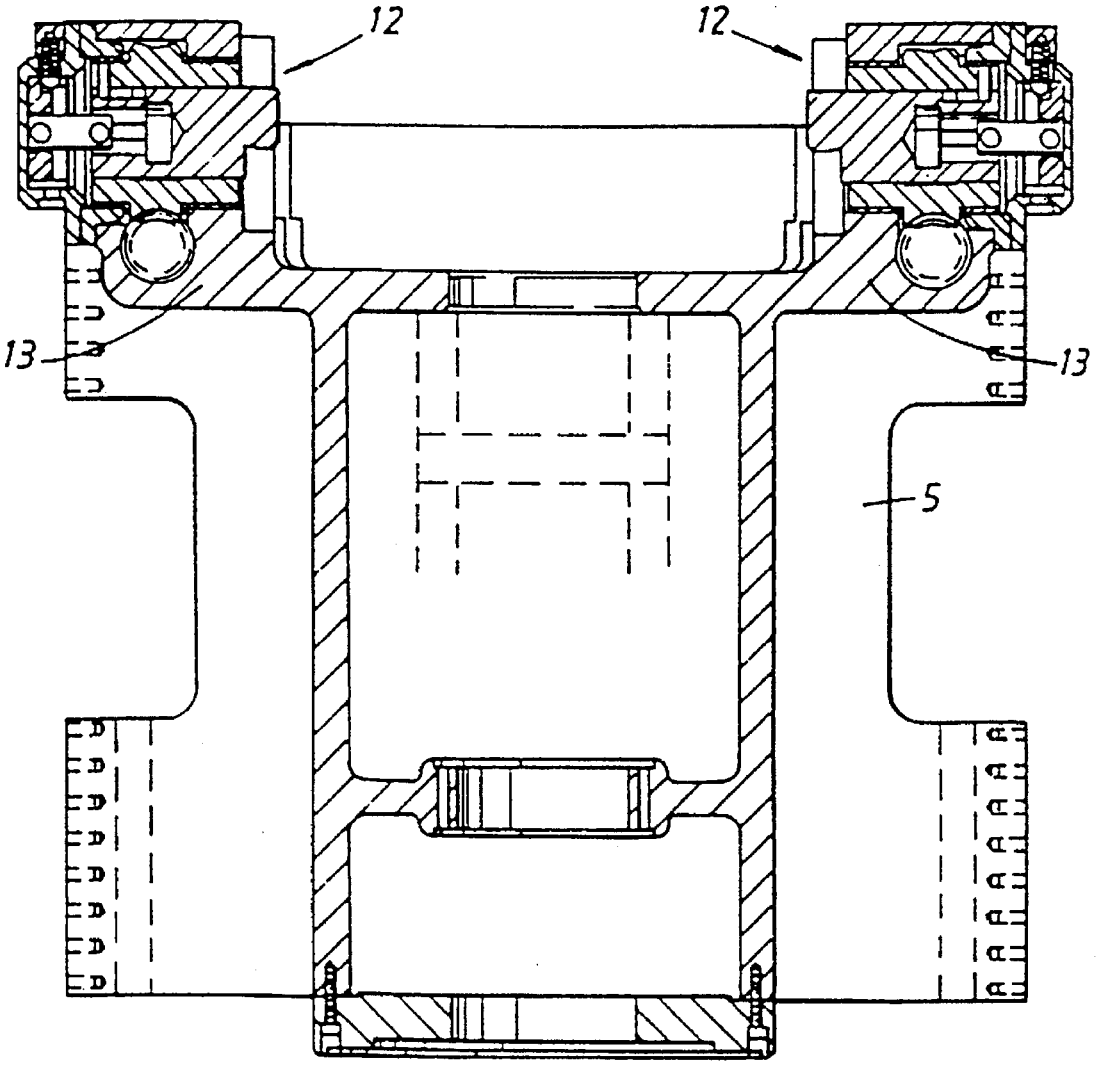
FIG. 2 is a sectional view of the pinion stand housing taken on the line II—II in FIG. 1.

The roll stand illustrated in FIG. 1 comprises a roll unit 1, a cassette 2, a pinion stand 3, and a drive unit 4. The roll unit 1 is carried by the cassette 2, which is in turn carried by the pinion stand housing 5, as is also the drive unit 4. Two spindles 6, 7 are journalled in the pinion stand housing and are drivingly connected to the rolls 9, 10 by means of a coupling holder 8 mounted to the housing. The pinion stand housing also carries a roll hoist mechanism 11.

Although not shown, the roll stand is mounted on a concrete supportive base structure which also carries a known displacement mechanism which is intended to move the cassette 2 linearly between a first position in which the cassette is in abutment with parts of the pinion stand housing, and a second position in which the cassette is positioned on a carriage means which can be moved transversely to the direction of cassette displacement. This arrangement enables the roll unit to be readily removed in the second position of the cassette, either by lifting the cassette with the aid of an overhead crane or by removing the roll unit on the carriage means, together with the cassette, and replacing the old roll unit with a new roll unit.

In order to enable the exchange of a roll unit to be effected quickly, two mutually identical fastener arrangements 12 are fixedly mounted on the pinion stand housing 5, these arrangements being located vertically immediately beneath the pinion stand housing and supported by side flanges 13 provided on said housing, as will best be seen from FIG. 1.

One such fastener arrangement 12 will now be described in detail with particular reference to FIGS. 3–6. The fastener arrangement illustrated in the Figures includes a cylindrical member 14 and a fastening device 15 which is journalled eccentrically in the cylindrical member and has a cylindrical shape with the exception of its bottom end 16 in FIG. 3, said bottom end having the shape of the segment of a circle when seen in cross-section. The cylindrical member 14 is journalled for rotation in the side flange 13 of the pinion stand housing and is rotated by a worm screw 17 which engages with a toothed ring 18 provided on the cylindrical member.

Connected to the cylindrical member 14 is a pin 19, one end of which projects radially inwards from inside the cylindrical member. This radially inwards projecting end of the pin 19 runs in a groove or slot 20, provided on the peripheral surface of the fastener device 15.

The end of the fastener device 15 opposite to the end 16 is provided with a central, cylindrical recess 21 and the defining wall of said recess is provided with two diametrically opposed grooves 22 which extend parallel with the longitudinal axis of the fastener device. These grooves receive the ends of a rod 23 which is carried by a link 24 which is pivotally connected at one end to the rod 23. The other end of the link 24 is pivotally connected to a further rod 25 carried by a rotatable disc 26 which is latched against rotation by a spring-biassed, displaceable bolt 27 which projects into a V-shaped recess in the disc.

Figure 3:
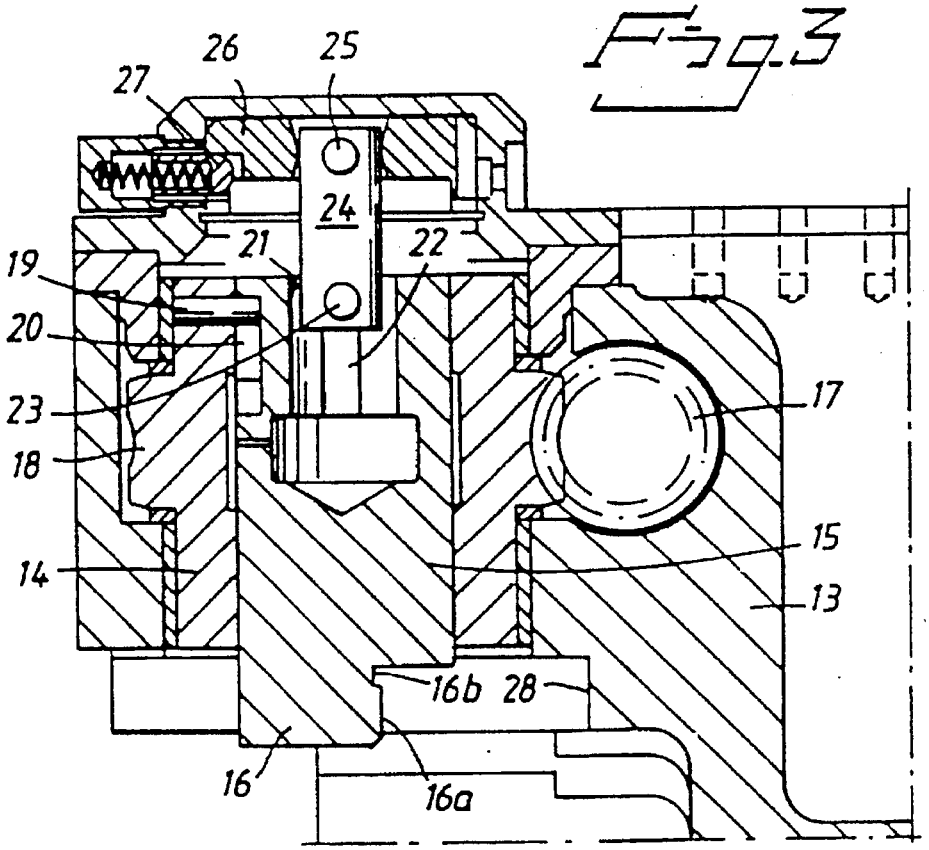
FIG. 3 illustrates part Of FIG. 2 in larger scale and shows one embodiment of an inventive fastener arrangement.
Figure 4:
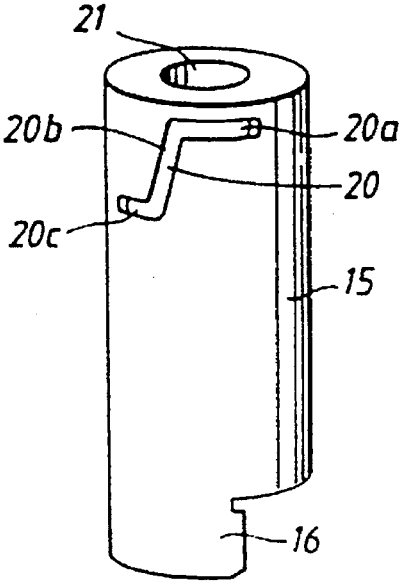
FIG. 4 illustrates a fastener device included in the fastener arrangement of FIG. 3.

FIG. 3 illustrates the fastening arrangement in an active state, in which a cassette post or column (not shown in the Figure) is fastened firmly between the flat surface 16*a* of the end 16 of the fastening device and a flat surface 28 of the pinion stand housing with a force of about 1000 kN. The cassette column is provided with surfaces complementary to the surfaces 16*a* and 28 and also with a flange which fits into the groove 16*b* in the end 16 of the fastening arrangement.

FIGS. 5A–5D illustrate schematically different stages of manoeuvering of the fastening arrangement, said Figures being cross-sectional views taken on a transverse plane relative to the axial direction of the fastening arrangement and extending through the pin 19. In the Figures, the position of the flat surface 16B of the fastening device 15 has been indicated in broken lines, and the Figures also show the projection of the groove 20.

Figure 5A:
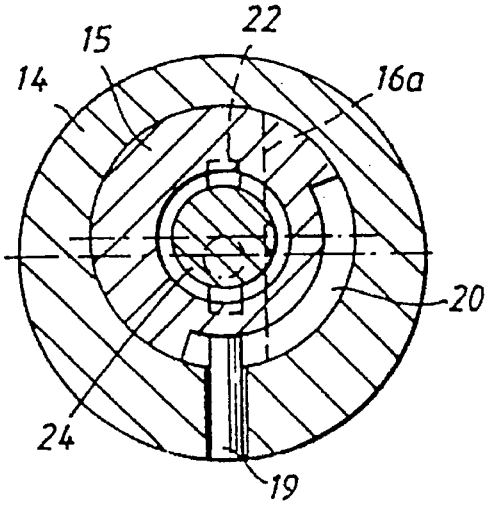
FIGS. 5A–5D are schematic vertical sectional views of the fastener arrangement illustrated in FIG. 3 and show different stages of fastener manoeuvering.

FIG. 5A illustrates the fastening arrangement in its active position, in which the pin 19 that projects out from the cylindrical member 14 is located in the part 20*a* of the groove 20 in the fastening device, close to the end thereof.

Figure 5B:
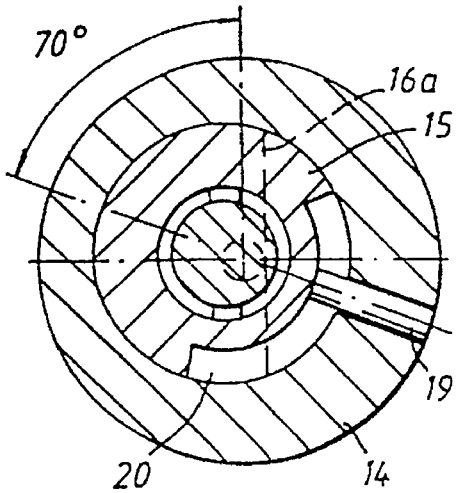

In FIG. 5B, the cylindrical member 14 has been rotated through 70° in an anti-clockwise direction with the aid of the worm 17. In this stage, the fastening device journalled eccentrically in the cylindrical member will have been moved laterally to the left in the FIG. 3. The pin 19 fixedly mounted in the cylindrical member moves freely in the groove part 20*a* during the whole of the rotary movement of the cylindrical member, since this part of the groove 20 extends at right angles to the rotational axis of the cylindrical member. In the position shown in FIG. 5A, the pin 19 has reached the end of the groove part 20*a*.

Figure 5C:
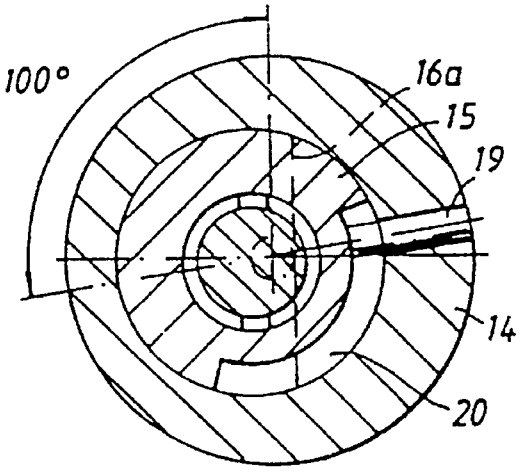

In the position shown in FIG. 5*c*, the cylindrical member 14 has been rotated through a further 30°. As the cylindrical member 14 rotates between the positions shown in FIGS. 5B and 5C, the pin 19 runs in the part 20*b* of the groove 20, this groove part 20*b* extending obliquely to the rotational axis of the cylindrical member. Since the latching device 15 is latched against rotation, as earlier mentioned, the pin 19 will move the latching device upwards in FIG. 3 during this part of the rotary movement of the cylindrical member. In order to make this possible, the extent to which the latching device is moved purely sideways during rotation of the cylindrical member between the positions shown in FIGS. 5A and 5B must be sufficient to ensure that the end 16 of the fastening or latching device 15 will pass free from the outwardly projecting flange on the cassette column coacting with the groove 16*b* at this end. In the position shown in FIG. 5C, the pin 19 has reached the end of the groove part 20*b* and the end 16 of the fastening device is inserted fully into the cylindrical member 14.

Figure 5D:
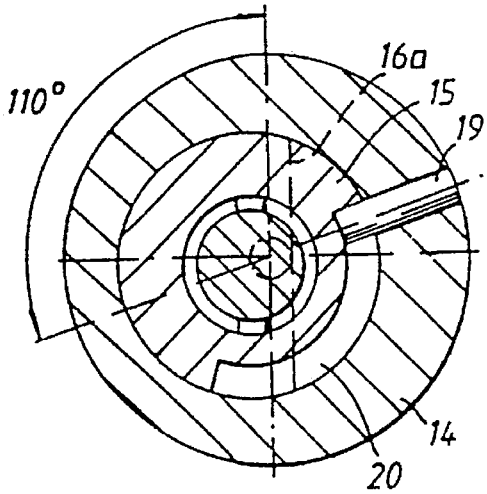

The cylindrical member 14 is then rotated through a further 10°, to the terminal position shown in FIG. 5D. During this further rotation, the pin 19 moves in the groove part 20*c* which, similar to the groove part 20*a*, extends at right angles to the rotational direction of the cylindrical member.

The cassette 2 is now completely free from the pinion stand housing 5 and can be moved linearly away from said housing, to enable quick exchange of the roll unit.

Upon completion of this exchange and after a new cassette containing a new roll unit, or after the same cassette that has been provided with a new roll unit, has been brought into abutment with the pinion stand housing, the worm is rotated in the opposite direction so that the cylindrical member will rotate clockwise from the position illustrated in FIG. 5D to the position illustrated in FIG. 5A. As the cylindrical member rotates, the fastening device will move in the same manner as that described with reference to FIGS. 5A–5D, but in the opposite direction. When the cylindrical member 14 has reached the position shown in FIG. 5A, the abutment Surface 16*a* on the end 16 of the fastening arrangement will be in abutment with the surface on the cassette post or column which is complementary to the surface 16*a*. As will be seen from FIG. 5A, the groove 20 permits the cylindrical member to rotate through a further 10° before the terminal position is reached, thereby enabling the fastening device to move laterally further to the right in FIG. 3.

Figure 6:
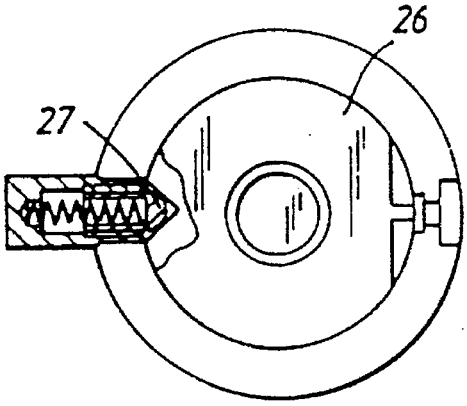
FIG. 6 illustrates the fastener arrangement of FIGS. 3–5 from above.

As the cylindrical member rotates, the fastening device will be influenced by the torque that is generated as a result of friction between those surfaces of the cylindrical member, the fastening device and the pin which move relative to one another, and also by the peripherally directed force component exerted by the pin as it moves in the part 2O*b* of the groove 20. This torque is transmitted to the disc 26 via the rod 23, the link 25 and the further rod 25, said disc 26 being latched against rotation by means of the spring-biassed bolt 27. Should the inward or outward movement of the fastening device be prevented for some reason or other, for instance if the cassette column has not been moved into abutment with the pinion stand housing in the manner intended as the column is moved linearly, the pin 19, as it reaches the part 20*b* of the fastening arrangement groove 20 as the cylindrical member rotates, will exert on the fastening device 15 a force of such power as to cause the fastening device to rotate against the action of the spring force acting on the bolt 27. The bolt will thereby be moved radially outwards from the position shown in FIG. 6. The bolt 27 is also provided with an electrical contact plate which when the bolt is in its inserted position, as shown in FIG. 6, completes an electric circuit to an electric motor (not shown) which drives the worm 17. Thus, if the bolt is moved away from this position, the electric motor will stop and driving of the worm will cease. This arrangement ensures that the fastening device cannot be moved to an active position unless the cassette is correctly positioned in abutment with the pinion stand housing, and also that the fastening device will not be damaged should the intended movement patterns be interrupted. The bolt will preferably be connected to a signalling device which functions to indicate when the bolt has been moved away from its normal position.

As before mentioned, when the cassette is disconnected from the pinion stand housing, the cassette will rest on a displacement mechanism disposed on the concrete supportive base structure. In order to prevent contact of the cassette with the supportive base structure while the rolling mill is operating and damage the displacement mechanism as a result of vibrations or the like, the cassette abutment surfaces which coact with the pinion stand housing are so configured that when the cassette is moved into abutment with said housing by the displacement mechanism, the cassette will solely abut the lower part of the pinion stand housing whereas the remainder of the mutually coacting abutment surfaces will be slightly spaced from one another. The lower mutually coacting abutment surfaces of the cassette and the pinion stand housing are so arranged that the lower abutment surfaces on the cassette are unable to move vertically in relation to the pinion stand housing subsequent to the cassette having been brought into abutment with the pinion stand housing. By virtue of the fastening arrangements 12, the entire cassette is therefore caused to swing around an axis through the lower abutment surfaces until remaining coacting abutment surfaces come into abutment with one another. By appropriate configuration of the cassette, the cassette can be caused to move completely free from the supportive base structure during this pivotal movement of the cassette.

As will be understood, the aforedescribed and illustrated embodiment of a fastening arrangement can be modified in many ways within the scope of the present invention. For instance, the worm may be driven by some means other than an electric motor, for instance a hydraulic motor, the pin 19 may be mounted on the fastening device and the groove 20 provided on the cylindrical member. The eccentric positioning of the fastening device in the cylindrical member can also be varied, depending upon the desired movement pattern and also the extent to which the different parts of the groove 20 are angled. The devices which latch the fastening device against rotation can also have configurations different to those shown, for instance the devices may be comprised of axially extending rods which run in undulations disposed on the outside of the fastening device. These rods may be attached directly to a rotatable disc which is so journalled as to enable it to move laterally. The aforedescribed mechanism for switching-off the worm drive motor may also be replaced with a detector which detects directly the torque to which the fastening device is subjected and delivers a switch-off signal to the worm drive means when this torque exceeds a determined value. The invention is therefore restricted solely by the content of the following Claims.

I claim:

1. In an arrangement for fastening a roll unit carrier firmly to a roll stand, said carrier being brought into abutment with the roll stand by moving the carrier linearly, the improvement wherein the roll stand includes a fastening device which is journalled eccentrically in a rotatable cylindrical member and has one end provided with a fastening surface, which in a fastening mode of the arrangement, coacts with a complementary surface on the carrier; and the arrangement includes drive means for rotating the cylindrical member between a fastening position in which the carrier is pressed against the roll stand at a predetermined force, and a release position in which the carrier can be moved towards or away from the roll stand without being impeded by the fastening device, and the fastening device is journalled for axial movement in the cylindrical member.

2. An arrangement according to claim 1, wherein the drive means for rotating the cylindrical member comprises a worm screw which meshes with a toothed ring mounted on the cylindrical member.

3. An arrangement according to claim 1, further comprising an element which prevents rotation of the fastening device.

4. An arrangement according to claim 1, wherein the cylindrical member includes a pin which moves in a groove provided in the fastening device therewith to guide axial movement of the fastening device relative to the cylindrical member.

5. An arrangement according to claim 1, wherein the fastening device is subjected to a torque, and said arrangement further comprises means for detecting the torque and for delivering a switch-off signal to the drive means of the cylindrical member when said torque exceeds a determined value.

6. An arrangement according to claim 1, wherein when bringing the carrier into abutment with the roll stand, abutment is achieved with mutually coacting first abutment surfaces on the carrier and the roll stand that are spaced slightly from a supportive base structure; the fastening device is located at a greater distance from the supportive base structure than the first abutment surfaces; and mutually complementary second abutment surfaces of the carrier and the roll stand located at the fastening device are spaced slightly apart in the movement direction of the carrier as the carrier is moved into abutment with the roll stand, wherein the carrier is caused to swing as the mutually complementary second abutment surfaces on the carrier and the roll stand are moved into abutment with one another as the fastening arrangement is maneuvered to its fastening position.

* * * * *